United States Patent [19]

Mayer et al.

[11] 3,960,071

[45] June 1, 1976

[54] REFUSE COMPACTOR

[75] Inventors: Rolf Mayer, Giengen; Walter Menzel, Landshausen, both of Germany

[73] Assignee: Bosch-Siemens Hausgeräte GmbH, Munich, Germany

[22] Filed: Feb. 26, 1975

[21] Appl. No.: 553,435

[30] Foreign Application Priority Data

Feb. 28, 1974 Germany ..... 2409491
Mar. 11, 1974 Germany ..... 2411543

[52] U.S. Cl. ..... 100/229 A; 100/283; 100/289

[51] Int. Cl.[2] ..... B30B 1/18

[58] Field of Search ..... 100/229 A, 285, 286, 100/287, 289, 294, 283; 74/519, 520; 254/126, 10 C, 10 R

[56] References Cited

UNITED STATES PATENTS

| | | | |
|---|---|---|---|
| 3,714,890 | 2/1973 | Moon | 100/229 A |
| 3,772,984 | 11/1973 | Karls et al. | 100/289 X |
| 3,817,170 | 6/1974 | Mayer | 100/229 A |
| 3,842,729 | 10/1974 | Mandrup | 100/229 A |

*Primary Examiner*—Billy J. Wilhite
*Attorney, Agent, or Firm*—Michael J. Striker

[57] ABSTRACT

A refuse compactor, particularly for household refuse, has an upwardly open container mounted in a supporting frame and a pressure platen movable into and out of the container. A parallelogram drive for the platen is provided and includes a horizontal guide, a carriage which is movable along the guide, at least two pair of levers mounted for pivoting about a common pivot axis and each having ends connected to the platen and to the carriage respectively, a screw spindle connected with the carriage and with a motor so as to effect shifting of the carriage when it is rotated by the motor, and reinforcing members which connect at least two of the levers to form a structural unit. A traverse member is mounted in the frame above the platen remote from the motor, and a pair of guide levers is provided, each having one end pivoted to one of the levers of one pair, and another end connected to the traverse member. A bearing journals one end of the screw spindle and the other end is driven by the motor.

10 Claims, 5 Drawing Figures

Fig.3
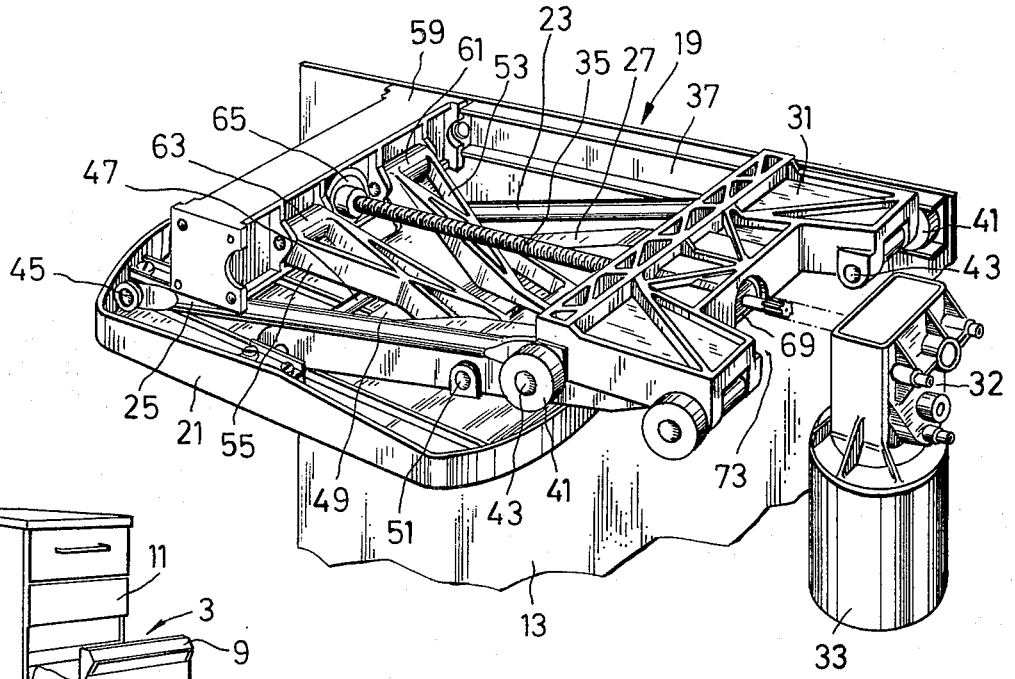
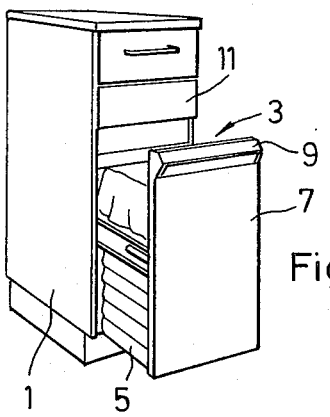
Fig.1
Fig.4
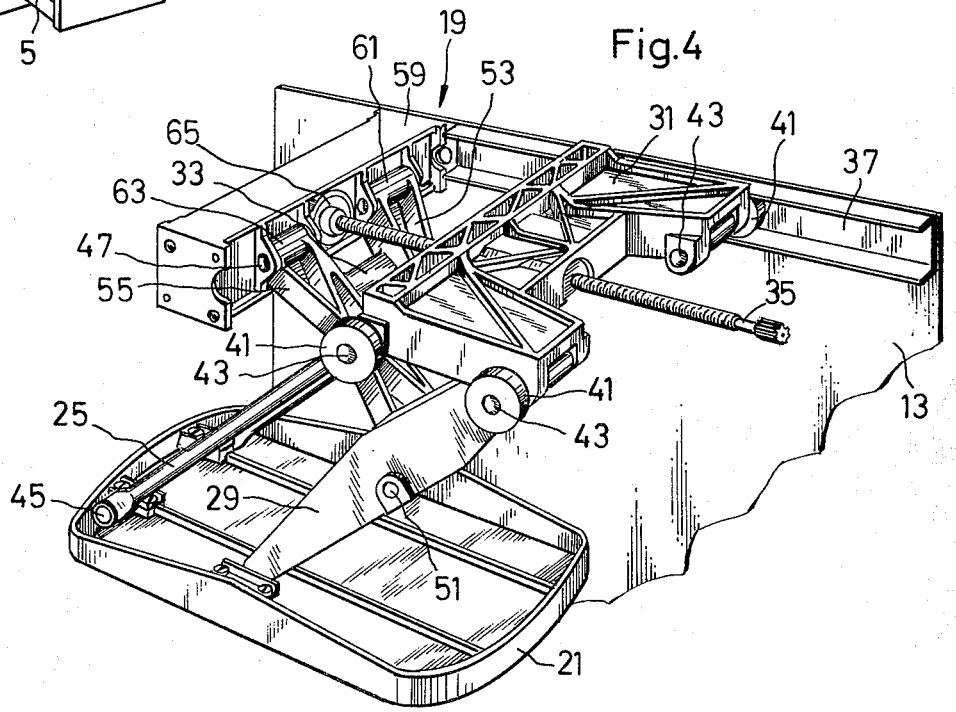

REFUSE COMPACTOR

BACKGROUND OF THE INVENTION

The present invention relates to a refuse compactor in general, that is a compactor for compressing bulky substances and materials, especially household refuse such as kitchen waste, empty containers, cans, bottles and the like.

Refuse compactors of this general type are already commercially available. One of these has a frame, a container in the frame, and a parallellogram drive which moves a platen into the container in order to compress material located therein. The parallellogram drive has two pair of levers which are closely adjacent in vertical planes and pivotable about common axis. One end of each lever is mounted on a shiftable carriage and the other end of the levers are mounted at different sides of a bolt which is mounted in the center of the circular platen, extending axially of the latter. Because of the small lateral spacing between the levers, their relatively large length and because of the disadvantageous central force transmission by the levers upon the platen, the parallellogram drive of this known construction is not very resistant to flexing and bending. It is therefore particularly susceptible to reaction forces which act non-symmetrically and eccentrically upon the pressure platen and which develop when the platen compacts material in the container which is of differential composition, for example if at one side of the container the material is softer than at the other side. For this reason this known construction is not suitable for compacting of material which includes relatively large components, such as bottles, cans and the like and which when compressed will produce reaction forces which vary substantially in magnitude and which may suddenly and uncontrollably shift from one location of the platen to another. Since these reaction forces act only very rarely centrically and symmetrically upon the platen, they cause strong tilting moments to act upon the platen which are transmitted to the parallellogram drive and tend to flex or deform the same. This, in turn, causes substantial bearing friction in the journals of the drive, and these may lead either to a blockage of the drive or at the very least result in early destruction of the journals.

These problems could potentially be overcome in this prior-art construction by significantly increasing the strength of the individual components of the entire device. However, this is not practical because it would so increase the expense of the device that it would no longer be economically feasible to produce the device; moreover, it is desired that such devices be relatively light in weight in order to make them readily transportable since they are primarily intended for household use, and such increase in the strength of the components would result in an undesirable increase in the weight of the device.

Another prior-art device of the type in question uses an approximately rectangular pressure platen and the levers of the parallelogram drive are pivoted to the corners of the platen, being spaced from one another in lateral direction to a significantly greater degree than in the first-mentioned device. However, if reaction forces act upon the pressure platen in this device, it also tends to a deformation or flexing of the levers of the parallellogram drive, bringing with it the same disadvantages which have already been outlined above. In addition, if the reaction forces are strongly asymmetrical and eccentric with reference to the pressure platen, the latter tends to be shifted laterally to an extend sufficient for it to engage the container and to damage the latter during its further motions. In certain circumstances it is also possible for the platen to become completely blocked against further movement in the container.

SUMMARY OF THE INVENTION

It is therefore a general object of the present invention to provide an improved refuse compactor which is not possessed of the disadvantages outlined above.

More particularly, it is an object of the present invention to provide an improved refuse compactor which avoids the aforementioned disadvantages, has small exterior dimensions and is light in weight.

A further object of the invention is to provide such an improved refuse compactor which is capable of reliably withstanding reaction forces which act upon the pressure platen in an asymmetrical and eccentric manner, for instance due to differential distribution and hardness of the material being compacted.

Still an additional object of the invention is to provide such a refuse compactor wherein a reliable guidance of the pressure platen is assured so that the platen is prevented from shifting laterally of its intended path of movement.

In keeping with these objects, and with others which will become apparent hereafter, one feature of the invention resides in a refuse compactor, particularly for household refuse, which briefly stated comprises a supporting frame, an upwardly open container in this frame, and a pressure platen movable into and out of the container. A parallellogram drive is provided for the platen and includes substantially horizontal guide means on the frame, a shiftable element movable along the guide means, at least two pair of levers mounted for pivoting about a common pivot axis and each having ends connected to the platen and to the shiftable element respectively, a screw spindle connected with the shiftable element and with a motor so as to effect shifting of the element upon being rotated by the motor, and reinforcing means connecting at least two of the levers to form a structural unit. There is further provided a traverse member mounted in the frame of the platen, a pair of guide levers each having one end pivoted to one of the pairs of levers substantially midway of the same, and another end connected to the traverse member, and a bearing which journals one end of the screw spindle.

This construction is not only highly compact, but is especially strong and resistant against any deformation or flexing of the parallelogram drive. It is capable of withstanding even very large reaction forces, and due to the compact construction the refuse compactor according to the present invention is ideally suited for use in applications where space is limited, such as is usually encountered in household applications.

An advantageous embodiment is obtained by having the guide levers connected with the traverse member at opposite sides of the bearing for pivotal movement about an axis which is vertically spaced from the pressure platen and located at least substantially above the center of the latter. This arrangement assures that when the pressure platen is in the upward position, that is in the position in which it is withdrawn from the container, the parallellogram drive will require an absolute minimum of space. The great rigidity of the parallellogram drive in the compactor according to the present invention, and its free movement even when subjected to substantial forces, can be further enhanced if, according to another concept of the invention, the spacing between the ends of the guide levers which are connected to the traverse member is greater than the spacing between the opposite ends of the guide levers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view showing a refuse compactor according to the present invention;

FIG. 3 is an enlarged-scale fragmentary perspective view, illustrating details of the parallellogram drive and the pressure platen of the refuse compactor in FIGS. 1 and 2, with the platen in the upper position;

FIG. 4 is a view similar to FIG. 3, but showing the platen in its lower position in which it compacts material in the container of the compactor.

DESCRIPTION OF THE PREFERRED EMBODIMENTS

Figure 2:
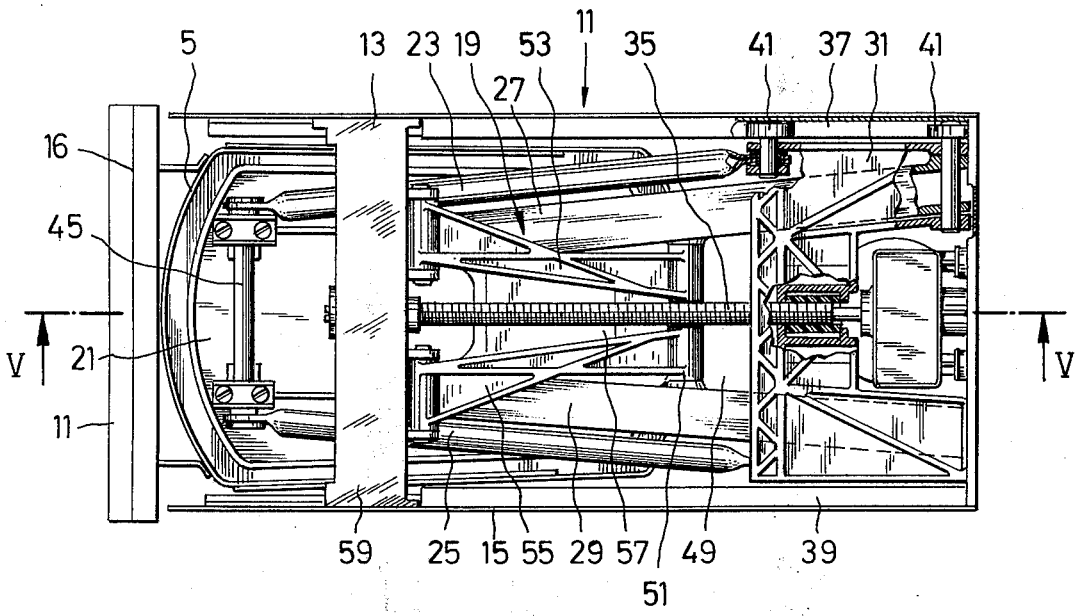
FIG. 2 is a top-plan view of the refuse compactor in FIG. 1, on an enlarged scale and with the housing omitted for the sake of clarity.

FIGS. 1–5 illustrate an exemplary embodiment of the invention. FIG. 1 shows a refuse compactor having a housing 1 which is dimensioned and configurated so that it can be included as part of a base unit of a kitchen, for permanent installation in the manner of a dishwasher. Of course, the housing 1 could also be mounted on rollers so that it can be made portable and moved from place to place. The housing 1 accommodates a refuse compacting mechanism 3 provided with a container 5 that can be pulled out of the front of the housing 1, analogously to a door, to afford the user access to the upper open side of the container 5 through which refuse to be compacted will be admitted. Usually, the container 5 will be lined with a bag of plastic or other material whose upper open end will be folded outwardly down the lateral sides of the container 5; after the compacting operation is completed the upper open ends will be folded in and tied, so that a neat package is obtained. Reference numeral 7 identifies a cover plate at the front end of the container 5; the plate 7 serves a decorative purpose and also completely closes the opening in the housing 1 when the container 5 is pushed into the latter. At the upper end of the plate 7 there is mounted a gripping bar 9 by means of which the container 5 can be pulled out and pushed into the housing 1. Reference numeral 11 identifies and only diagrammatically illustrates a control panel which is provided with the controls for operating the compactor; these controls are known and will therefore not be described or illustrated, especially as they do not form a part of the invention.

FIG. 2 shows more clearly that the container 5 enters, when it is pushed into the housing 1, into a frame which is essentially composed of side walls 13 and 15 and an end wall 17 that connects the side walls. A compacting arrangement 19 is guided in the upper region of the frame, having a pressure platen 21 that can be lowered into the upper open end of the container 5 to compact material therein. The stroke or lowering and raising movement of the pressure platen 21 is effected by a parallellogram drive which includes two pairs of levers 23, 25 and 27, 29 of identical length and mounted for pivoting about identical axis. The ends of the levers of the two pairs are connected with the pressure platen 21 and with the respective four corners of a slidable element 31 which is configurated as a carriage and which is horizontally displaceable in horizontal guides 37, 39 in response to the rotation of a screw spindle 35 that is driven by an electric motor 33.

In the illustrated embodiment the guides 37 and 39 are configurated as U-shaped rails which are mounted at the upper edges of the side walls 13 and 15 and between the arms of which the rollers 41 of the carriage 31 are guided; these rollers 41 are mounted on pins 43 which project from the carriage in laterally outward direction in the region of the four corners of the carriage.

The levers 23 and 25 are rods of circular cross-section and their ends adjacent the pressure platen 21 are mounted on a bolt 45 which extends parallel to the plane of the panel 11, being secured on the platen 21. The opposite ends of the levers 23 and 25 are connected to those pins 43 of the carriage 31 which are closest to the bolt 45. The ends of the levers 27 and 29 adjacent the pressure platen 21 are pivoted on a bolt 47 which is mounted on the platen 21 in the region of the longitudinal center line of the same. The opposite ends of the levers 27 and 29 are pivoted to the pins 43 on the carriage 31 which are farthest spaced from the bolts 45, that is which are closest to the motor 33. The transverse spacing of the arms 23 and 25, and also of the arms 27 and 29, is substantially greater in the region of the carriage 31 than in the region of the platen 21. At least in the center region the levers 27 and 29 are united to form a single structural unit (compare FIG. 2) by a reinforcing element in form of a plate 49. Approximately at the middle of the levers 27 and 29 which are reinforced by the plate 49 there is located a journal 51 to which there are pivoted two guide levers 53 and 55. These guide levers 53 and 55 are reinforced by reinforcing ribs and are also connected to form a unitary structure by means of a reinforcing portion 57. The other ends of the guide levers 53 and 55 are spaced farther from one another in transverse direction than the ends which are journalled at 51, and they are pivoted at a traverse member 59 which is mounted in the frame above the platen 21 and connects the side walls 13 and 15 of the frame with one another. The traverse member 59 is provided with two journals 61 and 63 at which the guide levers 53 and 55 are pivoted to it; located between these journals 61 and 63 is a self-aligning bearing 65 having calotte-shaped cooperating bearing components and journalling one end of the screw spindle 35. A further bearing for the screw spindle 35 is configurated as a threaded sleeve and provided at the lower side of the carriage 31 in the middle region of the latter.

The end of the screw spindle 35 which is remote from the self-aligning bearing 65, that is the right-hand end for example in FIGS. 3 and 4, is splined and received in a correspondingly internally splined hollow output shaft 67 (compare FIGS. 3 and 5) of a gear unit 32 which is mounted on the electric motor 33 and secured to the back wall 17 of the frame.

The spindle 35 could be connected with the carriage 31 by a member which is rigidly connected with the carriage and which converts the rotation of the spindle into an axial movement of the carriage lengthwise of the guides, i.e., axially of the spindle 35. This concept is included within the disclosure of the present invention.

However, we have found that it is still more advantageous if a different arrangement is chosen, as will be described subsequently. The first-mentioned arrangement transmits not only pressure and tension to the screw spindle 35, but also strong moment forces, especially when asymmetric or eccentric reaction forces are transmitted from the pressure platen 21 to the carriage 31 and tend to tilt the latter in its guide members 37 and 39. The torque which is then transmitted to the spindle 35 acts upon the journals thereof, causing an increased wear of the journals and therefore disadvantageously influencing the life of the compactor, as well as requiring increased energy to overcome the bearing friction which results.

The second possibility mentioned above is illustrated in the embodiment that has been chosen to explain the invention; it assures that of the forces which act during the operation of the compactor, only those components will be transmitted to the spindle 35 which act in axial direction of the latter.

Figure 5:
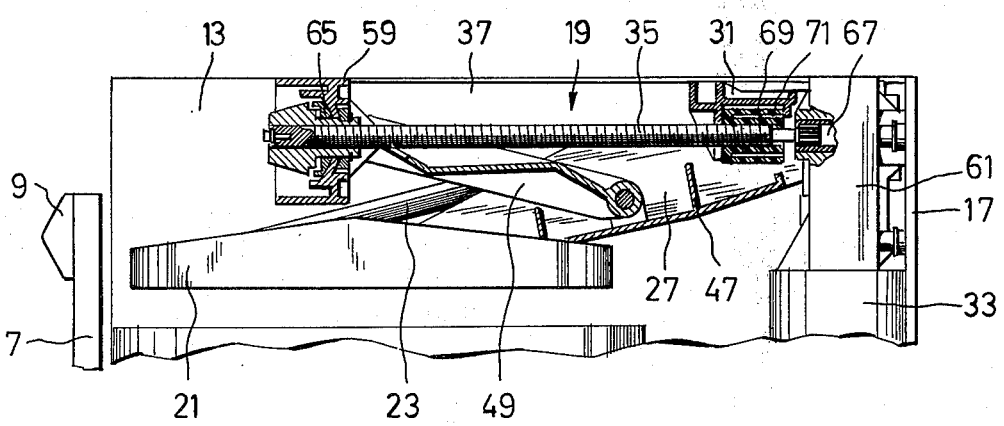
FIG. 5 is a section taken on line V—V of FIG. 2.

For this purpose, and as shown particularly in FIG. 5, the spindle 35 is connected with the carriage 31 by means of a connecting member 69 which in the illustrated embodiment is configurated as a rectangular nut of synthetic plastic material and which is received in a niche or recess 71 formed for this purpose in the carriage 31 and accessible from the downwardly directed side of the latter. The dimensions of the recess 71 and of the member 69 are so coordinated that the member 69 is received in the recess 71 non-rotatably relative to the carriage 31 and fixed in the direction of movement of the carriage 31.

The end of the carriage 31 which faces towards the motor 33 and the gear unit 32 is formed with a cutout 73 so that, when the carriage 32 assumes the position shown in FIG. 2, the gear unit 32 can extend into this cutout, thereby permitting the gear unit 32 and the motor 33 to be mounted closer to the traverse member 59 than would be possible — given the necessary displacement of the carriage 31 towards the right — if the cutout 73 were not present.

The provision of the member 69 and the manner in which it is mounted in the carriage 31, relieves the bearing of the spindle 35 of the forces which would otherwise be transmitted to them, and substantially reduces the friction which develops in operation in the drive, particularly that acting upon the member 69, so that the compactor according to the present invention requires less energy for its operation and has a greater lifetime than would otherwise be possible.

To operate the compactor of the present invention, the motor 33 is energized, causing the spindle 35 to be rotated and thereby resulting in movement of the carriage 31 lengthwise or axially of the spindle 35. If the carriage 35 is in its end position adjacent to the end wall 17 when the motor 33 is energized, then it moves towards the traverse member 59, displacing the platen 21 downwardly from the position shown in FIG. 3 to the position shown in FIG. 4 in which the platen 21 enters into the container 5 (compare FIG. 1) and compresses refuse located therein. Subsequently the direction of rotation of the spindle 35 is reversed, causing the platen 21 to be retracted upwardly back to the position shown in FIG. 3.

The particular configuration of the levers 23, 25 and 27, 29, as well as of the guide levers 53 and 55, and the V-shaped orientation of these levers relative to one another, assures that when the platen 21 is in the upper end position shown in FIG. 3 the various components will be nested within one another so that in this rest position they require comparatively little space. The relatively large spacing between the ends of the levers which are located adjacent the carriage 31, assures that the arrangement 19 is exceptionally resistant to twisting, flexing and deformation as a result of forces transmitted to it via the platen 21.

It is self-evident that while the invention has been illustrated on hand of a refuse compactor that is suitable for compacting of household refuse, it is equally applicable to any other type of refuse comparator, including commercial ones having a different basic construction and configuration than what is illustrated in FIG. 1, as long as the inventive concept is realized therein.

It will be understood that each of the elements described above, or two or more together, may also find a useful application in other types of constructions differing from the types described above.

While the invention has been illustrated and described as embodied in a refuse compactor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A refuse compactor, particularly for household refuse, comprising a supporting frame; an upwardly open container in said frame; a pressure platen movable into and out of said container; a parallellogram drive for said platen, including substantially horizontal guide means on said frame, a shiftable element movable along said guide means, at least two pair of levers mounted for pivoting about respective pivot axes and each having ends connected to said platen and to said shiftable element respectively, a screw spindle connected with said shiftable element and with a motor so as to effect shifting of said element upon being rotated by said motor, and reinforcing means connecting at least two of said levers to form a structural unit; a traverse member mounted in said frame above said platen; a pair of guide levers each having one end pivoted to one of said pairs of levers substantially midway of the same, and another end connected to said traverse member; and a bearing journalling one end of said screw spindle.

2. A refuse comparator as defined in claim 1; further comprising connecting means connecting said other ends of said guide levers to said traverse member at opposite sides of said bearing for pivoting movement about a pivot axis which is located upwardly of said platen substantially above the middle thereof.

3. A refuse compactor as defined in claim 1, wherein said one ends of said guide levers are spaced from one another by a distance which is greater than the spacing between said other ends of the same levers.

4. A refuse compactor as defined in claim 3; further comprising journals pivoting said one ends of said guide levers to the levers of said one pair and being located between said levers of said one pair.

5. A refuse compactor as defined in claim 1, wherein the spacing between the levers of each of said pairs decreases in direction from said shiftable element towards said platen.

6. A refuse compactor as defined in claim 1, wherein said shiftable element is provided with a recess; and further comprising an internally tapped member threaded onto said screw spindle and fixedly mounted in said recess for movement with said shiftable element in response to rotation of said screw spindle.

7. A refuse compactor as defined in claim 6, said shiftable element having a portion above said screw spindle and provided with a lower side facing said screw spindle and provided with said recess.

8. A refuse compactor as defined in claim 1, wherein said shiftable element is of substantially rectangular outline and has four corner regions, a pin projecting outwardly from each of said corner regions, and a roller mounted on each pin and supported on said guide means, each of said pins further pivotably mounting an end of one of said levers of said pairs of levers.

9. A refuse compactor as defined in claim 1; further comprising a gear unit mounted on said motor; and wherein said shiftable element has a side facing towards said motor and gear unit and provided with a cutout into which said gear unit can enter when said shiftable element approaches said gear unit.

10. A refuse compactor as defined in claim 9, wherein said bearing is a self-aligning bearing; and wherein said screw spindle has an other end received in a hollow output shaft of said gear unit.

* * * * *